United States Patent [19]

Koike

[11] 4,191,082

[45] Mar. 4, 1980

[54] KEY RANGE DIVIDING TYPE ELECTRONIC MUSICAL INSTRUMENT

[75] Inventor: Masahiko Koike, Hamamatsu, Japan

[73] Assignee: Nippon Gakki Seizo Kabushiki Kaisha, Hamamatsu, Japan

[21] Appl. No.: 950,328

[22] Filed: Oct. 11, 1978

[30] Foreign Application Priority Data

| | | | |
|---|---|---|---|
| Oct. 27, 1977 | [JP] | Japan | 52/128975 |
| Oct. 27, 1977 | [JP] | Japan | 52/144426[U] |
| Oct. 27, 1977 | [JP] | Japan | 52/144427[U] |
| Nov. 1, 1977 | [JP] | Japan | 52/146960[U] |

[51] Int. Cl.[2] ..... G10H 1/02

[52] U.S. Cl. ..... 84/1.19; 84/1.26; 84/DIG. 9

[58] Field of Search ..... 84/1.01, 1.17, 1.13; 84/1.19, 1.26, DIG. 9

[56] References Cited

U.S. PATENT DOCUMENTS

| | | | |
|---|---|---|---|
| 3,696,200 | 10/1972 | Bunger | 84/1.19 |
| 3,749,807 | 7/1973 | Adachi | 84/1.19 |
| 3,803,338 | 4/1974 | Adachi | 84/1.19 |
| 3,809,791 | 5/1974 | Uchiyama | 84/1.26 |
| 3,825,668 | 7/1974 | Okamoto | 84/1.17 |
| 3,848,142 | 11/1974 | Adachi | 84/1.13 |
| 3,935,783 | 2/1976 | Machanian et al. | 84/1.13 |

*Primary Examiner*—J. V. Truhe
*Assistant Examiner*—Forester W. Isen
*Attorney, Agent, or Firm*—Koda and Androlia

[57] ABSTRACT

An electronic musical instrument having the key range divided into upper and lower divisions, including a logical circuit converting the change-over position outputs of a key range dividing position selecting switch into gate control signals specifying corresponding key range dividing positions and a plurality of gates controlled by these gate control signals, thereby controlling the distributive mode of keyed tone signals to different tone color filters.

6 Claims, 6 Drawing Figures

KEY BOARD
KS
AT
SS
G5~C6
C5#~F5#
G4~C5
C4#~F4#
C3~C4
C3#~F3#
G2~C3
F2#
C2~F2#
C2#
C2
-V
CWG
10
44
M'
OG16
OG15
OG14
OG13
OG12
OG11
GT 16
GT 15
GT 14
GT 13
GT 12
GT 11
GT 26
GT 25
GT 24
GT 23
GT 22
GT 21
U
L
d
c
b
a
18
"1"
AT1
AT2
VR1
VR2
Q3
Q4
ST
12

KEY RANGE DIVIDING TYPE ELECTRONIC MUSICAL INSTRUMENT

BACKGROUND OF THE INVENTION

1. Field of the Invention

The present invention relates to a keyboard type electronic musical instrument in which the keyboard is divided into a plurality of divisions while tones are generated with tone colors differing for each divisions in the keyboard, and more particularly to an instrument of the above-described type in which the divisional point in the keyboard is variable.

2. Prior Art

A single-keyboard type electronic musical instrument embodying a division or the key range shown in FIG. 1 is known. (see Japanese Patent Publication No. 11381/72 for example). In this known electronic musical instrument, when transmitting tone source signals generated by a tone source signal generator 1 to tone color filters through key switch group 2, the tone source signals in medium tone range are switched to the high tone range side U or low tone range side L by means of a change-over switch 3 to thereby diminish the number of keys in the high tone range for playing melody to be less than that at the low tone range for accompaniment or increase the former to be larger than the latter. Namely, the tone source signals in the medium tone range are supplied to the tone color filters 4U for high tone range when the movable contact of the change-over switch 3 is at the U side and supplied to the tone color filters 4L for low tone range together with the tone source signals in the low tone range when the movable contact of the change-over switch 3 is at the L side. The outputs of tone color filters 4U and 4L are supplied to an output amplifier 7 in the form mixed at a mixing point 6 to be sounded by a speaker 8. Here the tone color characteristic of each of the tone color filters 4U and 4L are beforehand set to differ from each other by tone color selecting switches 5U and 5L.

Said key range dividing type electronic musical instrument, however, has presented various problems from the view point of practical use. Namely, it has only two key range dividing positions and few modes of tone color change. Also since it uses a mechanical switch for the dividing means, the increase of the dividing position complicates the constitution of the switch. Further, to add a coupler effect and others the connection to the switch becomes complicated disadvantageously.

SUMMARY OF THE INVENTION

An object of this invention is to provide a keying range dividing type electronic musical instrument having an improved key range dividing device which is capable of dividing variously the key range with simple operation and which is easy to manufacture and to maintain.

The key range dividing device according to this invention is characterized in that it includes a logical circuit converting the output of a key range dividing position selecting switch to a group of gate control signals specifying the corresponding key range dividing positions, and gates controlled by these gate control signals so as to control the distribution mode of keyed tone source signals to different tone color filters. Accoridng to this feature, various dividing position selecting switch. Also since only simple combination logic is required to set each dividing position during manufacture, this device is easy to manufacture and further convenient to maintain because each dividing position can be set and changed only by changing somewhat the combination logic. A further object of this invention is to provide a novel key range dividing type electronic musical instrument capable of effective attack or sustain control.

The key range dividing type electronic musical instrument according to this invention is characterized in that the attack time or sustain time of the keying envelope is independently controlled for each key range in response to the change of key range dividing position. Since the attack time or sustain time of the keying envelope is varied delicately and variously while the tone color characteristics differing with each key range are added, the tone colors in a broad sense becomes very rich to permit playing with a great variety of tone color.

A still further object of this invention is to provide a keying range dividing type electronic musical instrument having a keying control signal generating circuit which is capable of forming a keying envelope having variable attack time without any undesirable deformation of the envelope.

The keying control signal generating circuit according to this invention is characterized in that a capacitor for charging and discharging is through the second resistance for defining the charging time constant connected to the emitter of a transistor which receives at its base a key state signal through the first resistance for defining charging time constant and the transistor effects the transistor action or diode action in response to the on-off state of an attack time change-over switch connected to the collector of said transistor so that the charging time constant can be varied and thereby the attack time in the keying envelope can be varied. According to such a feature the first and second resistance for determining the charging time constant connected to the charging path of the capacitor are indirectly changed over through an electronic switch, i.e., transistor, so that the keying envelope can be formed with variable attack time and small waveform distortion.

A still furhter object of this invention is to provide with a keying range dividing type electronic musical instrument having a new effect control circuit capable of adding effective modulation effect.

The effect control circuit according to this invention is characterized in that when the tone outputs from a plurality of tone color filters provided correspondingly to respective divided key ranges are introduced into mixing sounding system, the modulation effect is added selectively by a plurality of change-over switch means. According to this feature any modulation effect can be added with respect to the upper and/or the lower divided key range to express a variety of renditions along with tone color variations according to the division of the key range.

BRIEF DESCRIPTION OF THE DRAWINGS

These and other objects, features and advantages of the present invention will be made more apparent from the following explanation of preferred embodiments thereof taken in conjunction with the accompanying drawings in which:

FIG. 3 is a waveform diagram showing keying control signals utilized by the system of FIG. 2;

FIG. 6 is a block diagram showing another example of the effect control circuit according to this invention.

DETAILED DESCRIPTION OF THE INVENTION

Figure 1:
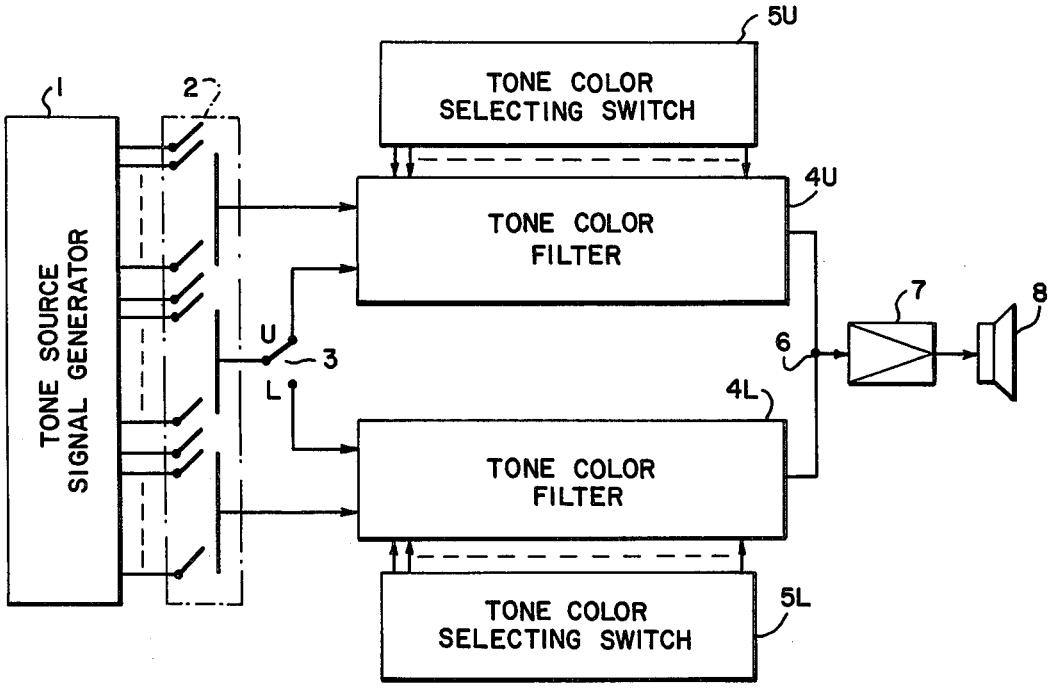
FIG. 1 shows a block diagram of a prior key range dividing type electronic musical instrument.
Figure 2:
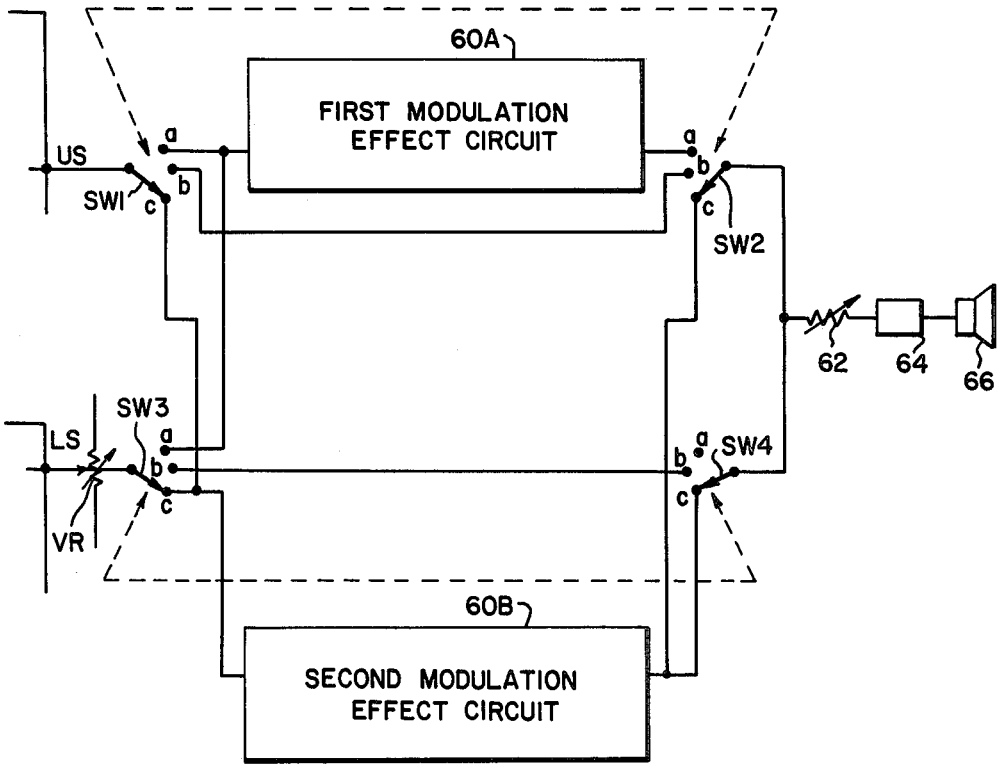
FIG. 2 shows a block diagram of an electronic musical instrument according to this invention.
Figure 2:
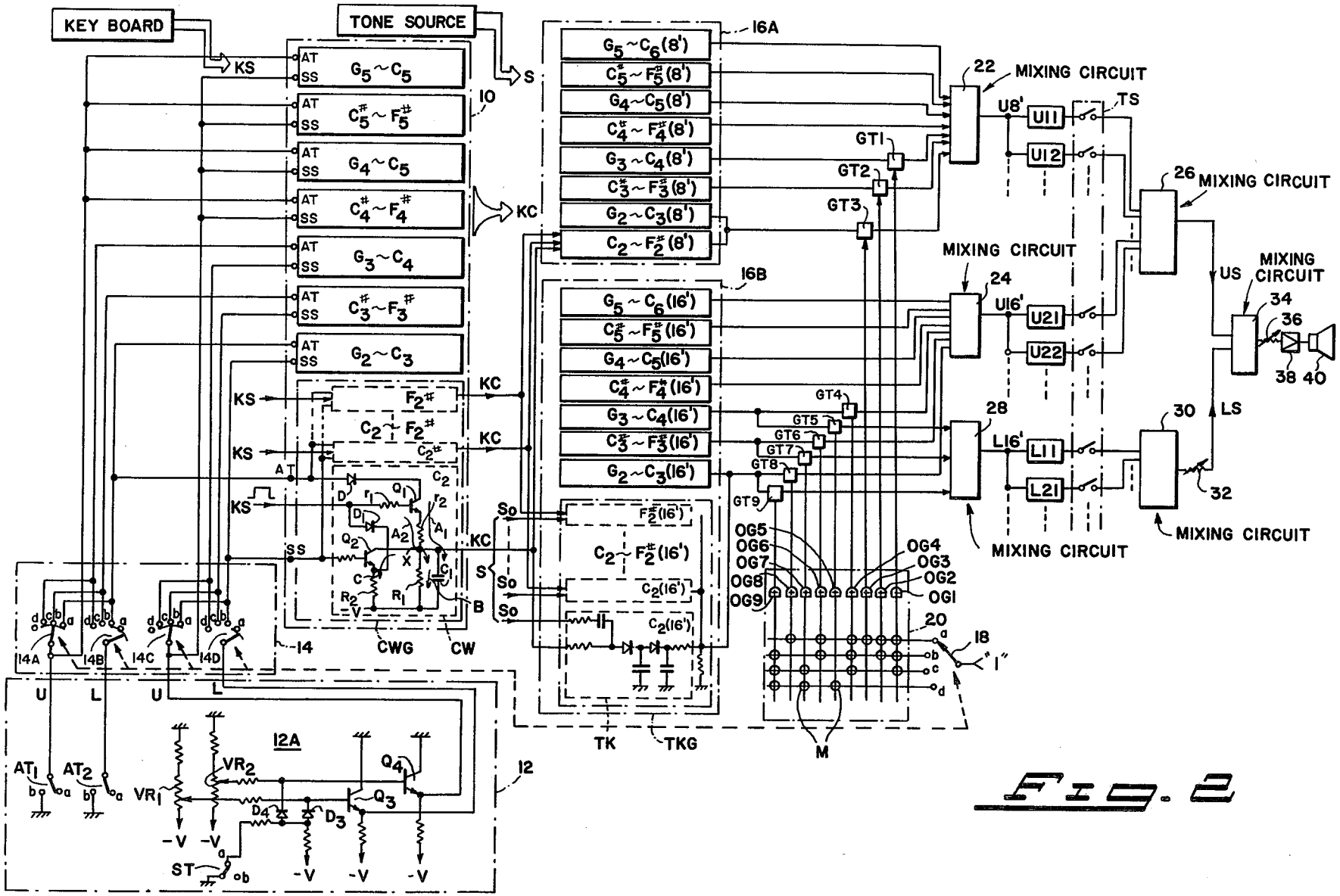

FIG. 2 shows an embodiment of a key range dividing type electronic musical instrument according to this invention. A keying control signal generator 10 is provided with a plurality of waveform forming circuits CW provided for every note name $C_2$–$C_6$ corresponding to a plurality of key switches, not shown, respectively. The key switches correspond to respective keys arranged in a single continuous keyboard. To a waveform forming circuit group CWG corresponding to each tone name group $C_2$–$F\#_2$, $G_2$–$C_3$, $C\#_3$–$F\#_3$, $G_3$–$C_4$, $C\#_4$–$F\#_4$, $G_4$–$C_5$, $C\#_5$–$F\#_5$, and $G_5$–$C_6$ are respectively connected common input terminals AT and SS of attack control and sustain control. To each input terminal AT of attack control is applied through a waveform control signal distribution circuit 14 attack time control signals generated by the waveform control signal generator 12 at attack control switches $AT_1$ and $AT_2$ for each of the upper and lower key ranges. To each input terminal SS of sustain control is applied through the waveform control signal distribution circuit 14 sustain time control signals generated through output transistors $Q_3$ and $Q_4$ by the waveform control signal generator 12 for each key range. The waveform control signal distribution circuit 14 is provided with three-contact short-circuit type rotary switches 14A–14D interlocked with a key range dividing position selecting switch 18 which has four fixed contacts a, b, c and d which will be later described, so as to change the destination of the waveform control signals such as attack time control signal and sustain time control signal in response to the change of key range dividing position by the switch 18. The keying control signal generator 10 responds to the attack time control signal and sustain time control signal supplied from the waveform control signal generator 12 through the distribution circuit 14 as mentioned above to impart the attack envelope and sustain envelope to the key state signal (concretely key-on signal) KS from each key switch for the generation of the keying control signal KC representing the desired keying envelope. These keying control signals KC are supplied to the corresponding keying circuit group TKG in each keying channel 16A or 16B so as to be sent to the input of the keying circuit TK of the corresponding note name. The keying channels 16A and 16B will be later described.

Next, a circuit arrangement for generating the keying control signal KC will be described with reference to an example of waveform forming circuit CW corresponding to note name $C_2$.

The waveform forming circuit CW is provided with two transistor $Q_1$ and $Q_2$ for controlling charging and discharging. The base of transistor $Q_1$ is grounded through a corresponding key switch and a resistance $r_1$ for determining the first charging time constant when that key switch is turned on. The state signal KS indicating the on-off state of this specific key switch is supplied to the base of transistor $Q_1$ through the resistance $r_1$. Also to the emitter of transistor $Q_1$ is connected a capacitor $C_1$ for charging and discharging through a resistance $r_2$ for determining the second charging time constant, and the collector of transistor $Q_1$ earthed through a diode D in the on-time of an attack control switch $AT_1$ or $AT_2$ in accordance with the change-over state of switch 14A or 14B. This diode D is an inverse current preventing diode which blocks the interaction between the waveform forming circuits when the ground potential is not applied from a circuit consisting of said switch 14A or 14B and attack control switch $AT_1$ or $AT_2$. Also to a capacitor $C_1$ is connected a resistance $R_1$ in parallel therewith for determining discharging time constant and through the parallel path of these capacitor $C_1$ and resistance $R_1$ and the resistance $r_2$ is applied a potential of $-V$ to the emitter of transistor $Q_1$. To the connection X of the parallel path of capacitor $C_1$ and resistance $R_1$ and the resistance $r_2$ is connected the collector of transistor $Q_2$, and the potential of $-V$ is applied to the emitter of this transistor through the resistance $R_2$ for determining the discharging time constant. Also, to the emitter of transistor $Q_2$ is supplied the key state signal KS through the diode $D_1$. The base of transistor $Q_2$ is driven in accordance with the change-over state of switches 14C or 14D by the output of output transistor $Q_3$ or $Q_4$ in the sustain control circuit 12A. The transistor $Q_3$ or $Q_4$ is driven to be in the ON-state respectively through diode $D_3$ or $D_4$ when a sustain switch ST (usually a foot switch of a normally-on type driven by a sustain pedal) is closed while it is subjected to variable control potential from variable resistance $VR_1$ or $VR_2$ respectively when the switch ST is opened. Thus the emitter potential of transistor $Q_3$ is controlled by the ground potential or the variable control potential respectively in response to the contact of the movable contact of sustain switch ST with a fixed contact a or b. This operation also applies to the transistor $Q_4$. With such sustain control circuit 12A a performer can, if he desires, make the movable contact of the sustain switch ST contact with the fixed contact b to set the emitter potential of transistors $Q_3$ and $Q_4$ arbitrarily by variable resistance $VR_1$ and $VR_2$. Further the keying control signal KC representing the keying envelope corresponding to the charging and discharging curve of capacitor $C_1$ as shown in FIG. 3 is taken out of the connection X.

Here will be described concretely the operation to obtain this keying control signal KC. Now assume that the movable contact of attack control switch $AT_1$ or $AT_2$ makes contact with the fixed contact b to maintain the collector of transistor $Q_1$ at the ground potential, while the movable contact of the sustain switch ST makes contact with the fixed contact a to maintain the base of transistor $Q_2$ approximately at the ground potential. In this state the key switch is in the off-state and the key-on signal line (anode side of diode $D_1$) is at $-V$ potential to place transistor $Q_2$ on the on-state so that the capacitor $C_1$ has discharged up through the parallel paths B and C of resistances $R_1$ and $R_2$. When the key switch is then subjected to the on-operation (key-on), the key state signal KS takes the ground potential level to turn on the transistor $Q_1$, and the transistor $Q_2$ is turned off as the ground potential is applied to the emitter of transistor $Q_2$ through the key switch and diode $D_1$. Accordingly, capacitor $C_1$ is charged substantially by the time constant of $r_2 \cdot C_1$ in the path of $A_1$ through transistor $Q_1$ and resistance $r_2$ through a very small current is allowed to flow through a path $A_2$. The potential variation at the connection X in the beginning of this charging corresponds to the rise envelope at the attack time in the keying control signal KC as shown in FIG. 3. When next the key switch is turned off (key-off), the key state signal KS takes the level of $-V$ so that the transistor $Q_1$ is turned off and tansistor $Q_2$ is turned on. Thus the charge on the capacitor $C_1$ is discharged through the paths B and C. The discharging curve at this time is represented as a relatively rapid attenuation (fall) envelope NST in the keying control signal KC shown in FIG. 3. By the above charging and discharging action of capacitor $C_1$, the keying control signal KC having such a key-on envelope as generally shown by solid line in FIG. 3 is obtained at the connection X.

Next, when the movable contact of attack control switch $AT_1$ or $AT_2$ makes contact with the fixed contact a, the collector of tansistor $Q_1$ is floating so that the transistor $Q_1$ does not affect the transistor action and the pn junction between the base and emitter acts only as equivalent diode. Thus, when the key state signal KS takes the ground potential level in response to the on-operation on the key switch, capacitor $C_1$ will be charged through the path $A_2$ passing resistance $r_1$-pn junction between base and emitter of tansistor $Q_1$-resistance $r_2$. The charging time constant at this time is represented by $(r_1+r_2)\cdot C_1$ and the corresponding charging curve is represented by a slow attack envelope shown by broken line in the keying control signal KC of FIG. 3. In this way, the operation of attack control switch $AT_1$ or $AT_2$ can vary the attack time in the key-on envelope of keying control signal KC arbitrarily.

Further, when the movable contact of sustain switch ST makes contact with the fixed contact b (when the sustain pedal is trodden) and the emitter potential of tansistor $Q_3$ or $Q_4$ is lowered ($-V$ side) by bringing the movable element of variable resistance $VR_1$ or $VR_2$ close to the $-V$ side, the transistor $Q_2$ lowers its base potential to reduce the collector current of transistor $Q_2$. Thus, the discharging current of capacitor $C_1$ discharging through transistor $Q_2$ and resistance $R_2$ becomes small so that the capacitor $C_1$ will discharge with larger time constant compared with that in the case of the movable contact of sustain switch ST contacting with the fixed contact a. The discharging curve in this case is represented by a relatively slow attenuation (fall) envelope SST in the keying control signal KC in FIG. 3.

The operation of forming the keying envelope as described above applies also to other waveform forming circuits than the waveform forming circuit CW corresponding to note name $C_2$. What keying control signal of key-on envelope is concretely generated in the key-on time by the waveform forming circuit CW or waveform forimg circuit group CWG corresponding to each note name $C_2$-$C_6$ depends upon the distribution mode of waveform control signal in the distribution circuit 14 and the operational state of switches $AT_1$, $AT_2$ and ST and variable resistances $VR_1$ and $VR_2$ in the waveform control signal generator 12.

In the distribution circuit 14 shown in FIG. 2, the attack time control signal generated from the attack control switch $AT_1$ corresponding to the upper key range at the high tone side (U) is supplied directly to the waveform forming circuit groups corresponding to the notes $C^{\#}_4$-$F^{\#}_4$ or higher, while being supplied to the waveform forming circuit groups respectively corresponding to the note groups $G_3$-$C_4$, $C^{\#}_3$-$F^{\#}_3$, $G_2$-$C_3$ and $C_2$-$F^{\#}_2$ through the respective fixed contacts c, b and a of switch 14A. The attack time control signal generated from attack control switch $AT_2$ corresponding to the lower key range at the lower tone side (L) is supplied to the waveform forming circuits respectively corresponding to the note name groups $G_3$-$C_4$, $C^{\#}_3$-$F^{\#}_3$, $G_2$-$C_3$ and $C_2$-$F^{\#}_2$ through the respective fixed contacts d, c and b of switch 14B. On the one hand, the sustain time control signal generated from output transistor $Q_4$ corresponding to the upper key range is supplied to the waveform forming circuit group corresponding to the notes $C^{\#}_4$-$F^{\#}_4$ or higher while being supplied to the waveform forming circuit groups resepctively corresponding to the note name groups $G_3$-$C_4$, $C^{\#}_3$-$F^{\#}_3$, $G_2$-$C_3$ and $C_2$-$F^{\#}_2$ through the respective contact c, b, and a of switch 14C. The sustain time control signal generated from the output transistor $Q_3$ corresponding to the lower key range is supplied to the waveform forming circuit groups respectively corresponding to the note name groups $G_3$-$C_4$, $C^{\#}_3$-$F^{\#}_3$, $G_2$-$C_3$ and $C_2$-$F^{\#}_2$ through the respective fixed contact d, c and b of the switch 14D. Here, which of the upper or lower key range each of the note name groups $C_2$-$F^{\#}_2$, $G_2$-$C_3$, $C^{\#}_3$-$F^{\#}_3$ and $G_3$-$C_4$ belongs to is suitably set by the key range dividing position selecting switch 18 as will later described. The four switches 14A to 14D in said distribution circuit 14 are interlocked with the switch 18 as shown by broken line to change the destination of each waveform control signal in accordance with the change of the key range dividing position. For example, in the change-over state shown in FIG. 2 in which the movable contact of switch 18 makes contact with the fixed contact a, the key range is not divided so that all waveform forming circuit groups corresponding to the notes $G_3$-$C_4$ and lower belong to the upper key range, wherein the attack time control signal from the attack control switch $AT_1$ through switch 14A and the sustain time control signal from output transistor $Q_4$ through switch 14C are respectively supplied to these circuit groups. On the other hand, when the movable contact of switch 18 makes contact with the fixed contact d, all waveform forming circuit groups corresponding to the notes $G_3$-$C_4$ and lower belong to the lower key range, and the attack time control signal from the attack control switch $AT_2$ through switch 14B and the sustain time control signal from output transistor $Q_3$ through switch 14D are respectively supplied to these circuit groups. Referring to the operation example shown here, the distribution operation of waveform control signal in the dividing circuit 14 when the movable contact of switch 18 makes contact with the fixed contact b and c will be easily understood.

Next, the constitution and operation of circuit system following the tone keyer provided with two keying channels 16A and 16B will be described. To effect a so-called coupler effect, two keying channels 16A and 16B of 8 feet system and 16 feet system are in parallel provided in the embodiment shown in FIG. 2. A tone source signal supplied to a keying circuit in the channel 16 corresponding to a certain note name is higher by one octave, for example, than that supplied to a keying circuit in the channel 16B correspond to the same note name. In each of the keying channels 16A and 16B a diode type keying circuit TK, well known per se, receiving the tone source signal $S_o$ of a certain note name and the corresponding keying control signal KC is provided for every note name $C_2$ to $C_6$, while the output of the keying circuit TK for every note name in a group $C_2$–$F\#_2$, $G_2$–$C_3$, $C\#_3$–$F\#_3$, $G_3$–$C_4$, $C\#_4$–$F\#_4$, $G_4$–$C_5$, $C\#_5$–$F\#_5$, or $G_5$–$C_6$ is mixed to be taken out. In FIG. 2, the keying circuit group corresponding to a group of note name is designated by symbol "TKG" while the tone source signal group put into the input of these keying circuit group TKG is designated by symbol "S". As a result of the above-mentioned constitution, in the output end of each keying circuit group TKG is generated the keying output in the form of the tone source signal $S_o$ which is amplitude modulated by the keying control signal KC in response to the operation of at least one corresponding key and in particular when a plurality of keys are simultaneously operated the keying output is generated in the form of one mixed for every key.

While the keying output group from 8 feet system keying channel 16A are respectively supplied to a mixing circuit 22, particularly the keying output group corresponding to the tone name group $G_3$–$C_4$, the keying output group corresponding to the tone name group $C\#_3$–$F\#_3$ and the keying output group corresponding to each of the tone name groups $G_2$–$C_3$ and $C_2$–$F\#_2$ are supplied to the mixing circuit 22 through the respective gate circuit GT1, GT2 and GT3. Also while the keying output group from the 16 feet system keying channel 16B are respectively supplied to a mixing circuit 24, in particular the keying output group corresponding to the note name group $G_3$–$C_4$, the keying output group corresponding to the note group $C\#_3$–$F\#_3$ and the keying output groups corresponding to the respective note name groups $G_2$–$C_3$ and $C_2$–$F\#_2$ are respectively supplied through the gate circuits GT4, GT6 and GT8 to the mixing circuit 24 on one hand and on the other hand respectively through the gate circuits GT5, GT7 and GT9 to a mixing circuit 28.

Here will be described a system to generate the gate control signal which is respectively supplied to the gate circuit GT1 and GT9. While the key range dividing position selecting switch 18 is connected with a "1" level signal source, it is provided with a movable contact rotatably driven by a rotary shaft and four fixed contacts, a, b, c and d making sequential contact with said movable contact to generate four change-over position outputs corresponding to the divided position on the key range of the keying output group from said keying channels 16A and 16B. A logical circuit 20 for gate control is provided with nine OR gates OG1–OG9 having the input connection shown by circular mark M to convert the changeover position output from switch 18 into a group of gate control signal specifying the corresponding key range dividing position. The gate control signal supplied respectively from the output of the respective OR gates OG1–OG9 is applied to the control input of the corresponding gate circuit GT1–GT9. When the gate control signal applied to each control input takes a "1" level, each of the gate circuits GT1–GT9 is in the signal transmitting state or on-state. According to such a constitution is obtained the interrelation between the divided position on the key range of keying output corresponding to each note name group and the change-over position of the movable contact of switch 18 relative to the fixed contact a, b, c and d as shown in the following Table 1;

Table 1

| a | | b | c | d | |
|---|---|---|---|---|---|
| ↓ | | ↓ | ↓ | ↓ | |
| [$C_2$ - $F\#_2$] | [$G_2$ - $C_3$] | [$C\#_3$ - $F\#_3$] | [$G_3$ - $C_4$] | [$C\#_4$ - $F\#_4$] | .....[$G_5$ - $C_6$] |

Accordingly, when the movable contact of switch 18 is in contact with the fixed contact a, the output of OR gates OG1, OG2, OG3, OG4, OG6 and OG8 is made a "1" level so that the corresponding gate circuits GT1, GT2, GT3, GT4, GT6 and GT8 are in the conductive state and all keying output groups in the 8 feet system are mixed in the mixing circuit 22 while all keying output groups in the 16 feet system are mixed in the mixing circuit 24. On the other hand when the movable contact of switch 18 makes contact with the fixed contact d, only the output of gate circuits OG5, OG7 and OG9 is made a "1" levels so that only corresponding gate circuits GT5, GT7 and GT9 are in the conductive state and the keying output group in the tone range lower than the note name group $G_3$–$C_4$ among the keying output group in the 16 feet system is supplied to the mixing circuit 28 to be mixed thereby. Similarly when the change-over position of switch 18 is taken at b or c, the keying output group in the sound range lower than the note name group $G_2$–$C_3$ or the keying output group in the sound range lower than the note name group $C\#_3$–$F\#_3$ among the keying output group in the 16 system will be mixed by the mixing circuit 28.

When the interrelation between the change-over position of switch 18 and the key range dividing position is desired to change, the input connection of OR gates OG1–OG9 may be suitable change in the logical circuit 20. Here the input connection of OR gates OG1–OG9 is preferably adapted to be readily changed by plug board and the like for maintenance. Further, the logical circuit 20 may have another type of logical constitution other than the combination of OR gates, for example, when another type of switch is used for the switch 18.

The mixed output U8' from the mixing circuit 22 in the high tone range of the 8 feet system is supplied to a mixing circuit 26 through at least one of tone color filters U11, U12 . . . for high tone range selected by a tone color selector TS, and the mixed output U16' from the mixing circuit 24 in the high tone range of the 16 feet system is supplied to the mixing circuit 26 through at least one of the tone color filter U21, U22 . . . for another high tone range selected by the tone color selector TS. By mixing the outputs U8' and U16' in the mixing circuit 26, the so-called coupler effect is produced. Further, the mixed output L16' from the mixing circuit 28 in the low tone range of the 16 feet system is similarly supplied to a mixing circuit 30 through at least one of the tone color filters L11, L12 . . . for low tone range selected by the tone color selector TS. The mixed tone signal US of the high tone range taken out of the mixing circuit 26 is applied to one input of the mixing circuit 34 and the mixed tone signal LS of the low tone range taken out of the mixing circuit 30 is applied to the other input of the mixing circuit 34 through the variable resistor 32 for attenuation. The mixed tone signal output of the mixing circuit 34 is supplied to an output amplifier 38 through a variable resistor 36 for adjusting the sound volume and converted to the corresponding acoustic signal or tone by a speaker 40 driven by the output of the amplifier 38.

Figure 4:
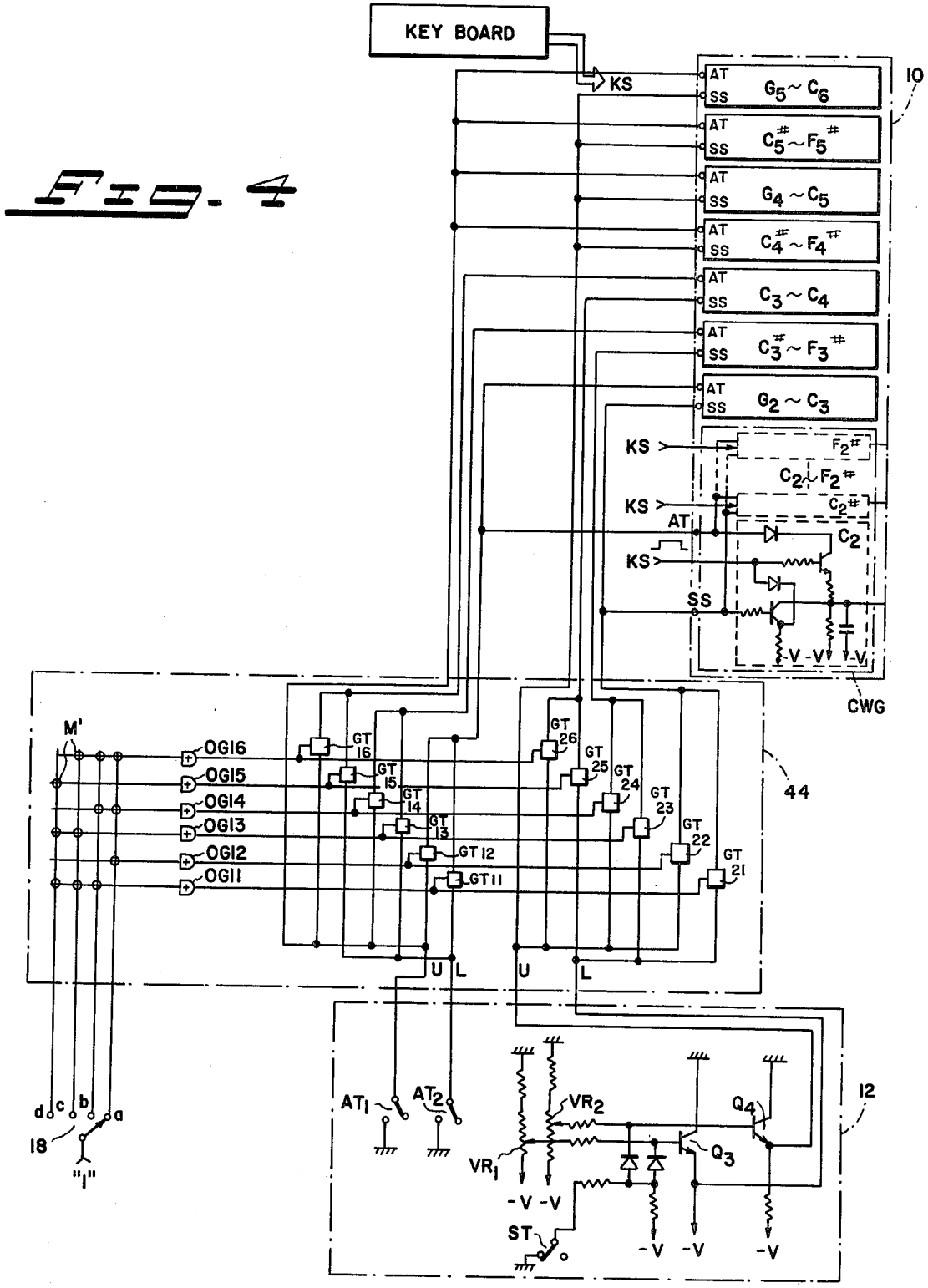
FIG. 4 is a circuit diagram illustrating another waveform control signal distribution circuit which can be used by the system of FIG. 2.

In the above embodiment an electronic distribution circuit 44 shown in FIG. 4 may be used in place of the distribution circuit 14. In FIG. 4, similar symbols are used for parts similar to those in FIG. 2. The waveform control signal distribution circuit 44 shown in FIG. 4 is provided with six OR gates OGL1–OG16 receiving the change-over position output from the fixed contacts a, b, c and d of the key range dividing position selecting switch 18 through the input connection shown by circular mark M' and gate circuits GT11–GT16, GT21–GT26 controlled by the output of this OR gate group respectively. The attack time control signal generated from the attack control switch $AT_1$ corresponding to the upper key range is supplied directly to the waveform forming circuit group in $C\#_4$–$F\#_4$ or higher sound range while being supplied to the waveform forming circuit groups respectively corresponding to the note name groups $G_3$–$C_4$, $C\#_3$–$F\#_3$, $G_2$–$C_3$ and $C_2$–$F\#_2$ through the respective gate circuits GT16, GT14 and GT 12. The attack time control signal generated from the attack control switch $AT_2$ corresponding to the lower key range is supplied to the waveform forming circuit groups respectively corresponding to the note name groups $G_3$–$C_4$, $C\#_3$–$F\#_3$, $G_2$–$C_3$ and $C_2$–$F\#_2$ through the respective gate circuits GT15, GT13 and GT11. On the other hand, the sustain time control signal generated from the output transistor $Q_4$ corresponding to the upper key range is directly supplied to the waveform forming circuit group in $C\#_4$–$F\#_4$ or higher sound range, while being supplied to the waveform forming circuit group respectively corresponding to the note name group $G_3$–$C_4$, $C\#_3$–$F\#_3$, $G_2$–$C_3$ and $C_2$–$F\#_2$ through the respective gate circuits GT26, GT24 and GT22. The sustain time control signal generated from the output transistor $Q_3$ corresponding to the lower key range is supplied to the waveform forming circuit groups respectively corresponding to the note name groups $G_3$–$C_4$, $C\#_3$–$F\#_3$, $G_2$–$C_3$ and $C_2$–$F\#_2$ through the respective gate circuits GT25, GT23 and GT21. As mentioned above, the distribution circuit 44 is an alternative mechanical switch system distribution circuit which electrically or electronically represented and effects the same operative action as that shown in FIG. 2. For example when the movable contact of the key range dividing position selecting switch 18 makes contact with the fixed contact a, the output of the OR gates OG12, OG14 and OG16 is made "1" level and the gate circuits GT12–GT22, GT14–GT24, GT16–GT26 are respectively in the signal transmitting state. Accordingly, in this case no attack time control signal and sustain time control signal respectively corresponding to the low sound range are distributed, and the attack time control signal and sustain time control signal corresponding to the high sound range are distributed and supplied to the waveform forming circuit group corresponding to the respective note groups $G_3$–$C_4$, $C\#_3$–$F\#_3$, $G_2$–$C_3$ and $C_2$–$F\#_2$. With reference to this operational example, the operation of signal distribution when the movable contact of switch 18 makes contact with the fixed contact other than the contact a will be self-evident.

The above-mentioned electronic musical instrument according to this invention can control independently the attack time and sustain time for every divided key range in response to the change of the key range dividing position so that a great variety of performance mode can be expressed. For example, by operating the key range dividing position selecting switch 18 to make the movable contact make contact with the fixed contact c, the keyboard is divided such that the note $C\#_3$–$F\#_3$ and lower are made the lower key range and the notes $G_3$–$C_4$ and higher are made the upper key range. In such state, the attack time control switches $AT_1$ and $AT_2$ and variable resistances $VR_1$ and $VR_2$ are respectively set such that the attack time and sustain time differ respectively in the upper key range and the lower key range, while the sustain switch ST can be suitably controllably turned on or off for performance. Here each operation of attack control switches $AT_1$ and $AT_2$, variable resistances $VR_1$ and $VR_2$ and sustain switch ST can be independently carried out for every key range every time the change-over state of the key range dividing position selecting switch 18 changes. Accordingly, a great variety of mode of performance expression concerning tone variation is obtained, and be selecting these mode suitably, delicate performance expression becomes possible.

Next, referring to FIG. 5, the electronic musical instrument provided with the effect control circuit according to this invention will be described. This electronic musical instrument is characterized in that when the tone outputs from tone color filters provided correspondingly to the respective divided key ranges are introduced into the mixed sound system, a plurality of change-over switches can suitable switch and control the tone outputs so as to selectively pass them through the modulation effect circuit. Reference numeral 50 designates the tone source circuit generating the tone source signal for every note name and 52 the keying device which keys and supplies the output of the tone source signal from this tone source circuit 50 for every note name in response to the corresponding key state signal form the key switch circuit 54. The tone signal generated from the keying device 52 is sent to the key range dividing circuit 56. This key range dividing circuit 56 is constituted in the same way as that shown in FIG. 2, and classifies each keyed tone signal into either of a 8 feet system high range tone signal U8', a 16 feet system high range tone signal U16' or a 16 feet system low range tone signal L16' in accordance with the key range dividing position designated by the key range dividing position selecting switch 58 to distribute and supply respectively to the corresponding tone color filter group, i.e., either of tone color filters U11, U12, . . . for the 8 feet system high range, tone color filters U21, U22 . . . for the 16 feet system high range or tone color filters L11, L12 . . . for the 16 feet system low range. The tone color selector TS comprises a plurality of tone color selecting switches connected in series to the output side of each tone color filter and operates these switches properly to select the tone color filter to be inserted into the circuit. The tone signals passed through the high range tone color filter are mixed at the output side of the tone color selecting switch and supplied to the movable contact of the change-over switch SW1 as the mixed high range tone signal US. On the other hand, the tone signals passed through the low range tone color filter are mixed at the output side of the tone color selecting switch and supplied to the movable contact of the change-over switch SW3 as the mixed low range tone signal LS through the variable resistance VR for attenuation.

The respective fixed contacts a of change-over switches SW1 and SW3 are together connected with the input of modulation effect circuit 60, and the respective fixed contacts b of switches SW1 and SW3 are directly connected to the respective fixed contacts b of change-over switches SW1 and SW3 respectively. The respective fixed contacts a of change-over switches SW2 and SW4 are both connected to the output of the modulation effect circuit 60, and every movable contact of each of the switches SW2 and SW4 is connected to the input of the output amplifier 64 through the variable resistance 62 for adjusting the tone volume. To the output side of the output amplifier 64 is connected a speaker 66 for converting the tone signal to sound.

For the modulation effect circuit 60 may be used for example a circuit which applies phase modulation to the tone signal by use of electronic delay line to produce an ensemble effect (an example of this circuit is disclosed in U.S. Pat. No. 3,833,752), a circuit which modulates the amplitude and phase of the tone signal with the output of low frequency oscillator to produce an orchestra ensemble effect or various modulation effect circuits well known per se. Further the change-over switches SW2 and SW4 may be omitted.

Figure 5:
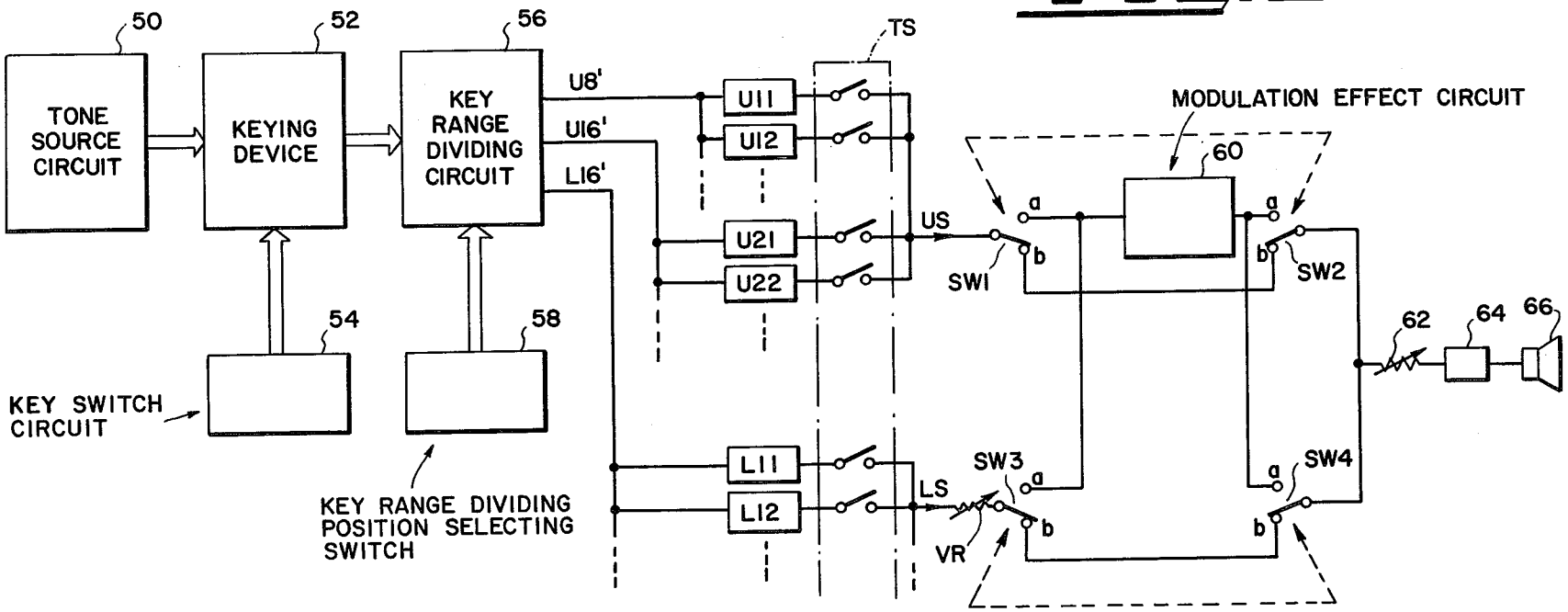
FIG. 5 shows a block diagram of an electronic musical instrument provided with an effect control circuit according to this invention.
Figure 2:
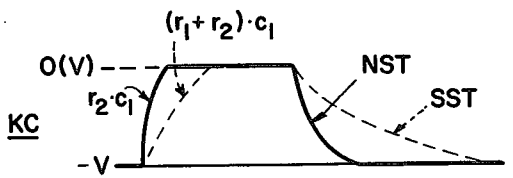

In the electronic musical instrument previously described with references to FIG. 5, the modulation effect circuit 60 and change-over switches SW1–SW4 are provided between each tone color filter and the mixing sound system to controllably switch the presence or absence of modulation effect independently for each of the upper and lower divided key ranges so that a great variety of performance expression becomes possible. Namely, several modulation effect adding modes for every key range are possible as shown in the following Table 2.

Table 2

| State of change-over | Upper key range | Lower key range |
|---|---|---|
| SW1, SW2 ... a side<br>SW3, SW4 ... a side | presence | presence |
| SW1, SW2 ... a side<br>SW3, SW4 ... b side | presence | absence |
| SW1, SW2 ... b side<br>SW3, SW4 ... a side | absence | presence |
| SW1, SW2 ... b side<br>SW3, SW4 ... b side | absence | absence |

On this Table 2, "presence" and "absence" show respectively the presence and absence of addition of modulation effect.

Accordingly, the following four types of modes of performance expression for example become possible.

(1) While the modulation effect is added to the upper key range to provide a tone or tones similar to that of a plurality of violins, the modulation effect is not added to the lower key range, but a clear tone or tones similar to that of cello and the like are provided.

(2) The modulation effect is not added to the upper key range but to the lower key range so as to provide the tone in the contrary mode to that in the case of the above-mentioned (1).

(3) The modulation effect is added as a whole to both the upper and lower key ranges to provide tones like background music.

(4) Without addition of the modulation effect to the whole key range, every key range is suited for a melody performance.

FIG. 6 shows a modulation effect control circuit in another embodiment according to this invention. The same symbol as that in FIG. 5 designates the same part in FIG. 6. The circuit constitution of this embodiment is characterized in that switches having respectively three change-over contacts a, b and c are used as the interlocked change-over switches SW1 and SW2, SW3 and SW4, while a plurality of different types of modulation effect circuits 60A and 60B are provided. Here a vibrato effect circuit can be used for the first modulation effect circuit 60A and a tremolo effect circuit for the second modulation circuit 60B respectively. This constitution can properly select the high range tone signal US to introduce into the mixing sound system by the interlocking swithces SW1 and SW2 through either the first modulation effect circuit 60A or the second one 60B, or through neither of them, while properly selecting the low range tone signal LS to introduce into the sound system by the interlocking switches SW3 and SW4 through either the first modulation effect circuit 60A or the second one 60B, or neither of them. Thus, the embodiment of FIG. 6 can advantageously add the ensemble effect to one key range and the tremolo effect to the other key range so that a greater variety of tone with richer musical property can be obtained.

It should be apparent to one skilled in the art that the above described embodiment are merely a few of the many specific embodiments which represent the application of the principles of the present invention. Numerous and varied other embodiments can be readily devised by those skilled in the art without departing from the spirit and scope of the present invention.

I claim:

1. In an electronic musical instrument comprising:

at least one continuous keyboard having a plurality of keys;

a keyer coupled to said plurality of keys for producing, in response to actuation of a key among said keys, a keyed output of a tone signal having an amplitude envelope and corresponding to note name of said actuated key;

a first filter circuit for coloring keyed tone signals corresponding to keys of a first group;

a second filter circuit having a different characteristic from that of said first filter circuit for coloring keyed tone signals corresponding to keys of a second group other than said first group of keys;

means for changing a dividing position between said first and second groups to vary the keys belonging to each group;

means for transmitting the keyed tone signals of said first and second groups to said first and second filter circuits respectively; and means for mixing outputs of said first and second filter circuits to produce a sound through a sound system;

the improvement wherein said signal transmitting means includes a plurality of gate means each receiving at least one keyed tone signal from said keyer for selectively delivering it to either said first or second filter circuit, and said dividing position changing means includes a dividing position selecting switch and a logical circuit connected to said switch for selectively supplying gate conductive signals to said plurality of gate means in accordance with the operation of said selecting switch thereby controlling the conduction of said gate means to change the dividing position between said first and second groups.

2. The musical instrument according to claim 1, in which each of said gate means comprises a first gate circuit and a second gate circuit both receiving the same keyed tone signal or signals from said keyer, said first and second gate circuits having outputs connected to said first filter circuit and second filter circuit respectively and controlled to be selectively conductive by said gate conductive signals.

3. The musical instrument according to claim 1, further comprising:

a plurality of means for varying at least one transient time of said amplitude envelope of the keyed tone signal or signals in accordance with control inputs applied thereto;

means for generating at least two different control signals which are the control inputs to said envelope varying means; and means controlled by said dividing position selecting switch for delivering said different control signals respectively to the envelope varying means corresponding to said first group and the envelope varying means corresponding to said second group so that keyed tone signals of the first and second groups are imparted with different amplitude envelopes with each other.

4. The musical instrument according to claim 3, in which each of said envelope varying means varies the rising time and decaying time of said amplitude envelope.

5. The musical instrument according to claim 3, wherein each of said envelope varying means comprises a transistor, first and second resistors connected respectively to the base and emitter of said transistor and used for determining first and second charging time constants, a capacitor for charging and discharging which is connected to the emitter of said transistor through said second resistor, and a circuit for providing a discharging path to said capacitor at key-off, a key state signal responding to the operation of said key being supplied to the base of said transistor through said first resistor, said different control signals being supplied to the collector of said transistor to control the operation/no-operation thereof, the charging and discharging of said capacitor being controlled by said transistor in response to said key state signal, whereby the rising time of said amplitude envelope can be varied through the operation/no-operation of said transistor.

6. The musical instrument according to claim 1, further comprising:

at least one modulation effect circuit provided between said filter circuits and said mixing means for adding a modulation effect to the colored tone signal or signals;

a first change-over switch provided between said first filter circuit and said modulation effect circuit for selectively supplying the output of said first filter circuit and the mixing means; and a second change-over switch provided between said second filter circuit and said modulation effect circuit for selectively supplying the output of said first filter circuit to the modulation effect circuit and mixing means.

* * * * *